US006053310A

United States Patent [19]

Mandel et al.

[11] Patent Number: 6,053,310

[45] **Date of Patent: *Apr. 25, 2000**

[54] PAGER COIN HOLDER

[76] Inventors: John M. Mandel, 4511 Chesapeake St. NW., Washington, D.C. 20016; David Jonathan Sherer, 7303 Brennon La., Chevy Chase, Md. 20815

[ * ] Notice: This patent issued on a continued prosecution application filed under 37 CFR 1.53(d), and is subject to the twenty year patent term provisions of 35 U.S.C. 154(a)(2).

[21] Appl. No.: 08/747,267

[22] Filed: Nov. 12, 1996

[51] Int. Cl.[7] ..... A45C 11/00

[52] U.S. Cl. ..... 206/81; 206/82; 453/50

[58] Field of Search ..... 206/8, 81, 815, 206/82–84, 460, 813; 453/39, 50, 56

[56] References Cited

U.S. PATENT DOCUMENTS

| | | | |
|---|---|---|---|
| D. 324,239 | 2/1992 | Halm . | |
| D. 329,192 | 9/1992 | Susac . | |
| D. 341,738 | 11/1993 | Balanesi . | |
| 904,244 | 11/1908 | Birch et al. | 453/50 |
| 986,158 | 3/1911 | Florsheim | 453/50 |
| 1,037,551 | 9/1912 | Sharp | 206/82 |
| 1,472,268 | 10/1923 | Edelin | 453/50 |
| 2,644,471 | 7/1953 | Brown | 453/50 |
| 2,892,537 | 6/1959 | Schwartz | 206/81 |
| 4,088,848 | 5/1978 | Weed . | |
| 4,165,573 | 8/1979 | Richards | 206/8 |
| 4,351,505 | 9/1982 | Wickersham . | |
| 4,776,797 | 10/1988 | Hernandez | 206/84 |
| 5,244,204 | 9/1993 | Zeller | 206/82 |
| 5,407,064 | 4/1995 | Huang | 206/8 |
| 5,499,710 | 3/1996 | Hoffman | 206/81 |

*Primary Examiner*—Paul T. Sewell
*Assistant Examiner*—Luan K. Bui
*Attorney, Agent, or Firm*—Akin, Gump, Strauss, Hauer & Feld, L.L.P.

[57] ABSTRACT

A coin holder for a radio pager and the like includes a generally rectangular body having a planar back surface supporting an adhesive layer for attaching the coin holder to a surface of a pager casing, for example. The coin holder body includes spaced apart flanges defining a coin receiving slot and leaving an open space for viewing the coin holder to determine if a coin is in the coin holder slot. The flanges each include a partial arcuate recess on an inner surface for registration with the coin to support the coin against unwanted dislodgement from the holder. A boss is formed on a surface of the body between the flanges, preferably disposed at the center of the coin, to position the coin in the coin receiving recesses of the flanges. Another portion of the body includes a surface on which suitable indicia may be printed or applied to the coin holder.

10 Claims, 1 Drawing Sheet

PAGER COIN HOLDER

FIELD OF THE INVENTION

The present invention pertains to a coin holder particularly adapted for use in combination with a radio pager and the like.

BACKGROUND

Radio pagers and similar communication devices have become ubiquitous. However, the use of a radio pager requires that the person receiving the paging signal take action to make a phone call to the party who has initiated the page. In this regard the person receiving the page may not have access to a toll free telephone and thus it is important that the person being paged have readily accessible the requisite coin for use in a toll activated telephone or "pay" phone. In the United States, for example, a significant number of toll telephones require the use of the twentyfive cent coin or "quarter" to initiate a call. Accordingly, it is of significant convenience to a person using a radio pager to have readily available on the pager the required coin to initiate a call in response to the page.

In this regard there has been a need to provide a coin holder which may be readily attached to the casing of a radio pager in a position which is convenient for inserting and removing a coin, is configured such that it is clear from casual inspection that a coin is, in fact, disposed in the holder, may be easily fabricated, may be easily attached to a variety of pager casing configurations, is constructed such as to provide for easy insertion of and removal of a coin while also providing suitable retention of the coin at all times and, for added convenience, includes means for placing personal identification information on or associated with the pager. It is to these ends that the present invention has been developed.

SUMMARY OF THE INVENTION present invention provides a coin holder, particularly adapted for use with and supported on a radio pager device and the like.

In accordance with one aspect of the present invention, a coin holder for a radio pager is provided which includes a body member which is easily mountable on a casing for a radio pager utilizing an adhesive member disposed on the coin holder. The coin holder is a substantially rectangular planar structure which facilitates ease of mounting on a generally planar surface of a radio pager, is constructed to provide for ease of insertion and removal of a coin with respect to the coin holder and is also constructed such that the presence or absence of a coin in the holder is readily ascertained by merely viewing the holder. These desiderata are satisfied by a coin holder having the aforementioned generally planar body member with opposed spaced apart flanges defining a coin receiving recess on the holder, which is particularly adapted to hold a U.S. currency twenty-five cent coin or "quarter". The flanges are provided with recesses for retaining the coin in the holder against unwanted dislodgement therefrom. The coin retention flanges are spaced apart to provide for easy recognition that a coin is supported in the holder or absent therefrom.

In accordance with another aspect of the invention a coin holder, is provided, particularly adapted for use with a radio pager or other portable devices, which has a surface thereon for personal identification information or other information desired to be placed on the holder.

Other advantages of the present invention include the provision of a coin holder which is easily fabricated of molded plastic or the like, is easy to use for inserting a coin in and removing a coin from the holder and is constructed in such a way as to be generally unobtrusive when placed in use mounted on a radio pager or similar device.

Those skilled in the art will recognize the above described features and advantages of the invention together with other superior aspects thereof upon reading the detailed description which follows in conjunction with the drawing.

DESCRIPTION OF A PREFERRRED EMBODIMENT

Figure 1:
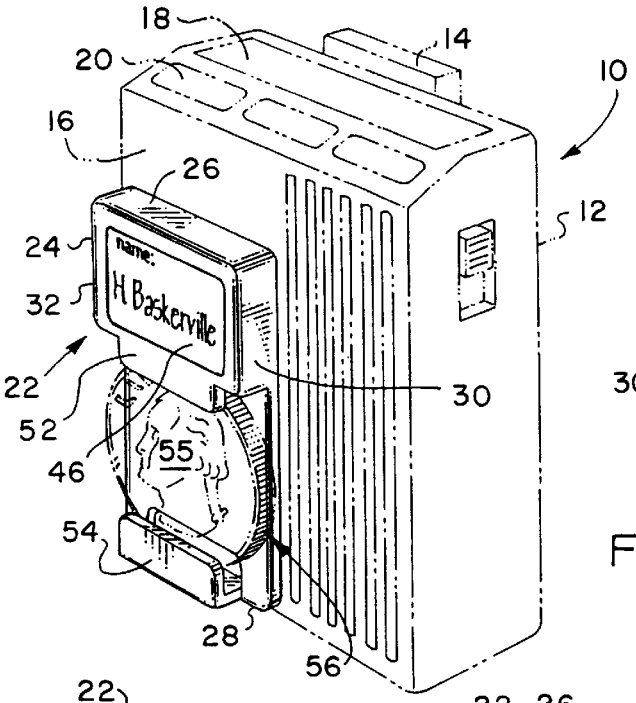
FIG. 1 is a perspective view of a radio pager device having the coin holder of the invention mounted thereon.
Figure 4:
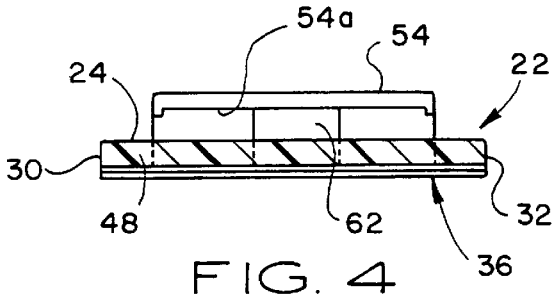
FIG. 4 is a section view taken along the line 4—4 of FIG. 3.

In the description which follows like elements are marked throughout the specification and drawing with the same reference numerals, respectively. The drawing figures are not necessarily to scale in the interest of clarity and conciseness.

Referring to the drawing, particularly FIG. 1, there is illustrated a conventional personal radio communication device, commonly known as a pager or "beeper", generally designated by the numeral 10. The pager device 10 is characterized by a generally rectangular casing 12 having suitable attachment means such as a belt clip or the like 14 mounted on a rear side thereof, as shown. The casing 12 also has a generally planar front side 16, an information display 18 and suitable control switches 20, for example. Paging devices, such as the paging device 10, are adapted to be worn on a user's belt, clipped to a shirt or trousers pocket, or clipped to the exterior of an article, commonly being carried by the user of the pager, such as a purse, briefcase, computer case, tool case or otherwise in a manner such that the pager is accessible, and may be easily heard and viewed at all times.

The pager 10 advantageously includes a coin holder in accordance with the invention, generally designated by the numeral 22. The coin holder 22 is particularly adapted to be mounted on a generally planar surface, such as the front side surface 16 of the casing 12 in a position which does not impair the use of the pager, is not otherwise a hindrance to the person carrying the pager, is generally unobtrusive but easily viewed any time the pager is viewable. In this regard the coin holder 22 is characterized by a generally rectangular body member 24 having a top side edge 26, a bottom side edge 28 and longitudinal side edges 30 and 32. A generally planar rear surface 34 is formed on body member 24, FIG. 5, and is adapted to support a member 36 having a pressure sensitive adhesive layer 38 formed thereon and secured to the surface 34. Suitable material reduction and contour accommodation grooves 37 may be formed in body 24 intersecting surface 34 to facilitate mounting the coin holder 22 on a non-planar surface. An easily removable adhesive layer cover sheet 40, is shown partially in FIG. 5, for example, and is removed when the coin holder 22 is to be mounted on casing side surface 16, for example.

Figure 2:
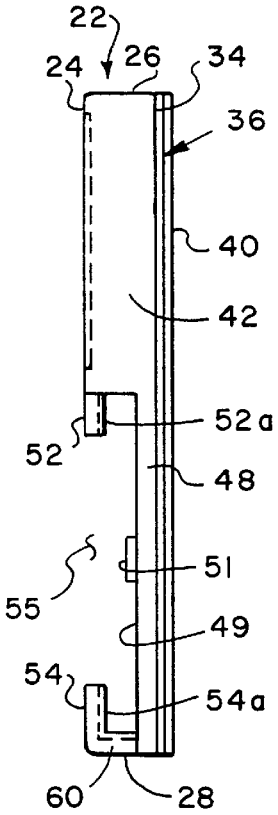
FIG. 2 is a side elevation of the coin holder of the present invention.
Figure 3:
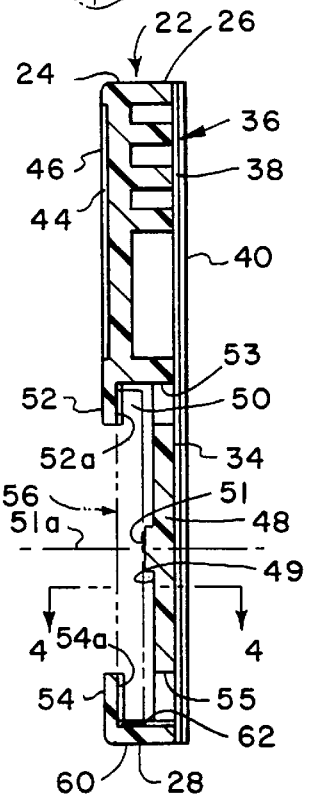
FIG. 3 is a section view taken along the line 3—3 of FIG. 5.

The coin holder body 24 is further characterized by a first generally rectangular portion 42 having a generally rectangular shallow recess 44, FIG. 3, formed therein providing a support for a suitable surface 46, FIGS. 1 and 3, on which identifying indicia, may be placed such as the name of the person using the pager 10, for example. The body 24 includes a second, generally rectangular portion 48, FIGS. 2 and 3, of reduced thickness with respect to the body portion 42 but integral therewith, and defining a coin receiving slot 50 formed between opposed flanges 52 and 54. The flanges 52 and 54 terminate substantially short of being contiguous with each other to leave a relatively large open space 55, FIGS. 1 and 2. Each of the flanges 52 and 54 has an arcuate recess, preferably a circular segment recess 52*a* and 54*a*, FIGS. 3 and 5, formed therein and conforming to the diameter of a circular coin such as a U.S. twenty-five cent coin or quarter 56, as shown. The coin holder 22 may, however, be proportioned to support coins of other sizes and shapes, if desired.

Figure 5:
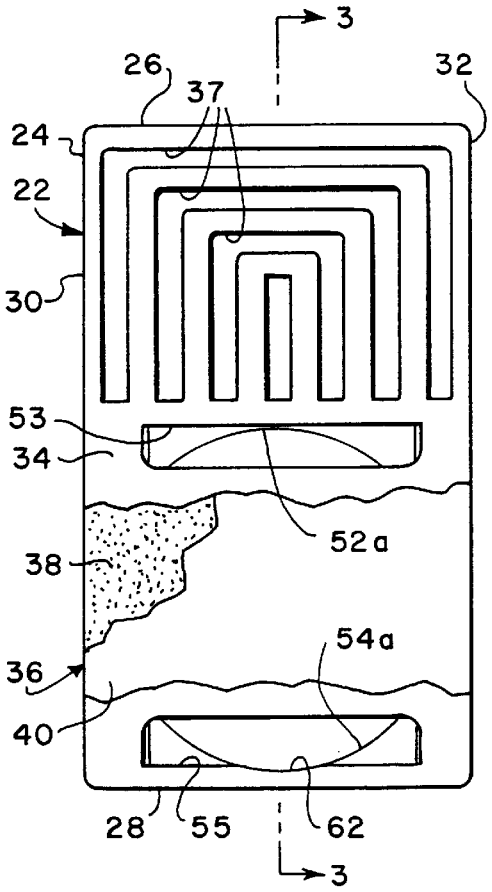
FIG. 5 is a plan view of the back side of the coin holder with the adhesive member partially removed therefrom.

As shown in FIGS. 2 and 3, the flange 54 is connected to body portion 48 by a web 60 having an arcuate recess 62 formed therein, see FIG. 5 also, for nesting a minor part, about 8% to 10%, of the edge of the coin 56 within the holder 22. A surface 49 of body portion 48 includes a generally cylindrical boss 51 projecting slightly therefrom and being disposed generally centrally with respect to an axis 51*a* which is also the central axis of the arcuate recesses 52*a* and 54*a*. Accordingly, a coin such as the coin 56, may be inserted in the holder 22 from either side edge 30 or 32 of the body 24, between the flanges 52 and 54 and the surface 49.

A coin will typically be inserted in the holder 22 such that it engages or slides over the boss 51 while snugly engaging the flanges 52 and 54 and, upon registration with the recesses 52*a* and 54*a* and 62, will be suitably retained therein. The flanges 52 and 54 may be dimensioned to be elastically deflected slightly during insertion and removal of the coin 56 and so as to urge the coin to remain in the recesses 52*a* and 54*a* and engaged with the boss 51. Moreover, the lower edge of the coin, viewing FIGS. 5, will also nest in the slight arcuate recess 62 in web 60. Thus, the overall combination of the flanges 52, 54, the boss 51 and the recesses 52*a*, 54*a* and 62 will suitably retain the coin 56 in the holder 22 while at the same time the coin may be quickly and easily removed by pushing on the side of the coin to move it laterally toward one or the other of the edges 30 or 32 to snap it out of the slot 50.

The coin holder 22 may be easily fabricated of injection molded plastic for example. Thanks to the configuration of the generally planar body 24 and the spaced apart coin retention flanges 52 and 54, the coin holder 22 may be easily mounted on a surface, such as the casing surface 16 for the pager 10, is generally unobtrusive, may be easily viewed to determine whether or not a coin 56 is retained in the holder and advantageously includes a surface, such as the surface 46, for placing suitable identifying indicia or other information on the holder.

Although a preferred embodiment of a coin holder in accordance with the present invention has been described in detail herein those skilled in the art will recognize that various substitutions and modifications may be made without departing from the scope and spirit of the invention as recited in the appended claims.

What is claimed is:

1. A coin holder for a radio pager, adapted for support on a surface of a casing for said pager, said coin holder comprising:

a body;

attachment means for attaching said body to said casing; and means for supporting a coin on said body comprising spaced apart flanges formed on said body and defining a coin receiving slot between said flanges and said body and wherein, at least one of said flanges includes an arcuate recess formed therein for registration with a coin to retain said coin in said slot.

2. The coin holder set forth in claim 1 including:

a boss formed on said body and engageable with said coin for retaining said coin in said recess in said flange.

3. The coin holder set forth in claim 1 wherein:

said flanges are spaced apart on said body to leave a space therebetween for observation of the presence or absence of said coin with respect to said coin holder.

4. The coin holder set forth in c'laim 1 wherein:

said body includes an arcuate slot adjacent one of said flanges engageable with an edge of said coin.

5. A coin holder for a radio pager, adapted for support on a surface of a casing for said pager, said coin holder comprising:

a body;

means for supporting a coin on said body comprising spaced apart flanges formed on said body and defining a coin receiving slot between said flanges and said body, wherein each of said flanges includes an arcuate recess formed therein for receiving said coin for retaining said coin on said body and in said slot;

a boss formed on said body and engageable with said coin for retaining said coin in said recesses in said flanges; and attachment means for attaching said body to said casing.

6. A coin holder, particularly adapted for attachment to a planar surface of a casing for a radio paging device, said coin holder comprising:

a generally rectangular body having top and bottom edges and opposed side edges and a front surface and a planar back surface, an adhesive layer secured to said planar back surface for attaching said body to a surface of said casing;

opposed spaced apart flanges formed on said body and defining a coin receiving slot there between on said front surface, said flanges leaving an open space for viewing the presence or absence of said coin supported on said coin holder;

wherein at least one of said flanges includes an arcuate recess formed therein for receiving said coin and for retaining said coin against unwanted dislodgment from said coin holder.

7. A coin holder, particularly adapted for attachment to a planar surface of a casing for a radio paging device, said coin holder comprising:

a generally rectangular body having top and bottom edges and opposed side edges and a front surface and a planar back surface, an adhesive layer secured to said planar back surface for attaching said body to a surface of said casing; and opposed spaced apart flanges formed on said body and defining a coin receiving slot therebetween on said front surface, said flanges leaving an open space for viewing the presence or absence of said coin supported on said coin holder, wherein at least one of said flanges includes an arcuate recess formed therein for receiving said coin and for retaining said coin against unwanted dislodgment from said coin holder and the other of said flanges includes an arcuate recess formed therein for receiving said coin.

8. The coin holder set forth in claim 7 including:

a surface formed on said body for engagement with said coin supported between said flanges for urging said coin in registration with said flanges, respectively.

9. A coin holder, particularly adapted for attachment to a planar surface of a casing for a radio paging device, said coin holder comprising:

a generally rectangular body having top and bottom edges and opposed side edges and a front surface and a planar back surface, an adhesive layer secured to said planar back surface for attaching said body to a surface of said casing;

opposed spaced apart flanges formed on said body and defining a coin receiving slot there between on said front surface, said flanges leaving an open space for viewing the presence or absence of said coin supported on said coin holder;

wherein said body includes grooves formed therein for causing said body to be deflectable to accommodate non-planar surfaces on casing.

10. A coin holder adapted for attachment to a surface of an article, said coin holder comprising:

a body having opposed sides, a generally planar back surface and an adhesive layer disposed thereon for attaching said coin holder to a surface of said article;

opposed spaced apart flanges formed on said body and defining a coin receiving slot therebetween for receiving a coin from either of said opposed sides of said body, said flanges leaving an open space for viewing the presence or absence of a coin supported on said coin holder;

generally arcuate recesses formed on corresponding inner surfaces of each of said flanges and having a diameter slightly larger than the diameter of a coin to be retained on said holder;

a boss projecting from a surface of said body between said flanges and engageable with a coin disposed on said holder for urging said coin to be disposed in said recesses on said flanges; and a surface on said body for applying selected indicia to said coin holder.

* * * * *